US007827926B2

(12) United States Patent
Payne

(10) Patent No.: US 7,827,926 B2
(45) Date of Patent: Nov. 9, 2010

(54) PROFILED PONTOON FOR WATERCRAFT

(76) Inventor: Stephen Payne, 171 Catherine Ave R.R. #2, Carleton Place, ON (CA) K7C 4L5

( * ) Notice: Subject to any disclaimer, the term of this patent is extended or adjusted under 35 U.S.C. 154(b) by 0 days.

(21) Appl. No.: 12/024,441

(22) Filed: Feb. 1, 2008

(65) Prior Publication Data

US 2009/0194015 A1 Aug. 6, 2009

(51) Int. Cl.
*B63B 1/00* (2006.01)

(52) U.S. Cl. ..... 114/292; 114/283

(58) Field of Classification Search ..... 114/39.26, 114/39.28, 61.1, 61.21, 61.32, 283, 292
See application file for complete search history.

(56) References Cited

U.S. PATENT DOCUMENTS 295,153 A * 3/1884 David ..... 114/61.21
1,738,979 A * 12/1929 Adelmann et al. ..... 114/283
3,307,511 A * 3/1967 Chapman ..... 114/61.21
4,348,972 A * 9/1982 Parsons ..... 114/39.26
RE33,359 E 10/1990 Lang
5,184,561 A 2/1993 Nickell, Jr.
5,373,799 A * 12/1994 Green ..... 114/39.28
5,379,710 A * 1/1995 Parnigoni ..... 114/292
5,784,977 A 7/1998 Schell et al.
6,240,865 B1 * 6/2001 Hubbard ..... 114/39.28
6,698,782 B2 3/2004 Bouchard
6,871,612 B2 3/2005 Gursoy
2001/0032574 A1 10/2001 Newton et al.
2002/0046688 A1 4/2002 Schell-Tomczak et al.

FOREIGN PATENT DOCUMENTS

EP 1431175 A1 6/2004
WO WO 2007-031068 A1 3/2007

* cited by examiner

*Primary Examiner*—Lars A Olson

(57) ABSTRACT

A pontoon for a watercraft. The pontoon has a vertical inboard side and a generally angled bottom defined by the inboard side height of the pontoon being greater than its outboard side height. The bottom has planing surfaces that define one or more channels, which produce lift upon the watercraft increasing its speed on water. An inboard horizontal planing surface allows relatively low speed planing.

1 Claim, 7 Drawing Sheets

Starboard pontoon

Port side pontoon

PROFILED PONTOON FOR WATERCRAFT

FIELD OF THE INVENTION

The present invention relates generally to pontoon boats. More particularly, the present invention relates to profiled pontoons for watercrafts.

BACKGROUND OF THE INVENTION

Pontoon boats are the choice of a large portion of the boating community mainly because of their excellent stability and safety. However, a drawback of these boats is there inability to travel at speeds comparable to those of other types of pleasure watercrafts. The intrinsic low speed of pontoon boats is due largely to the circular-cylindrical shape of the pontoons themselves. Low speed precludes pontoon boats from participating in any type of speed activity such as, for example, water-skiing. Further, the lack of speed of pontoon boats can expose them, and their occupants, to severe weather conditions when the boat finds itself at a distance from its dock and the weather rapidly changes for the worse.

Another problem with existing pontoon boats is that they are prone to being pushed sideways when navigating in cross winds, which makes the boats in question harder to maneuver. Additionally, they tend to bounce on the water when traveling in choppy water conditions.

Efforts have been made in the past to improve the planing ability of pontoon boats. For example, pontoons with lift pads fitted to the bottom, symmetrically about a keel or bottom region, are known. However, the symmetrical shape of these pontoons still makes the pontoon boats prone to crosswinds and can make for a very choppy ride when turning the boat. This is because the lifts pads on the pontoon that is on the inside of the turn tend to catch the water surface sporadically.

Therefore, it is desirable to provide pontoons that allow pontoon boats to travel at increased speeds and that provide improved maneuverability of the watercrafts.

SUMMARY OF THE INVENTION

It is an object of the present invention to obviate or mitigate at least one disadvantage of previous pontoon boats.

In a first aspect, the present invention provides a pontoon for a watercraft. The pontoon comprises an inboard side wall, an outboard side wall and a bottom, the inboard side wall and the outboard side wall are connected to the bottom. A submerged height of the inboard side wall is greater than a submerged height of the outboard side wall upon the pontoon floating on a body of water, the body of water having a water surface. The inboard side wall is substantially perpendicular to the water surface. The bottom includes at least two planing surfaces extending along a length of the pontoon. The at least two planing surfaces define a channel to produce lift upon the pontoon moving on the body of water.

The pontoon of can be such that the at least two planing surfaces include an inboard planing surface connected to the inboard side, the inboard planing surface being substantially parallel to the water surface. The outboard side wall can be substantially parallel to the inboard side wall. The channel can be shaped has an inverted-V. The pontoon can further comprise a top with an arcuate shape. The at least two planing surfaces can include at least one of a flat surface and a concave surface. At least one of the bottom, the inboard side wall and the outboard side wall can include aluminum. The pontoon can also comprise a buoyant material. The total number of planing surfaces can be three. The total number of planing surfaces can be four and the total number of channels can be two. The bottom can include a substantially vertical wall, the total number of planing surfaces can be five, and the total number of channels can be two with a first channel formed to the outboard side of the vertical wall and a second channel formed to the inboard side of the vertical wall.

In a further aspect, there is provided a kit for modifying a watercraft pontoon to obtain a modified pontoon. The kit comprises a contoured surface for being secured to the watercraft pontoon, the contoured surface has a bottom, an inboard side wall and an outboard side wall. A submerged height of the inboard side wall is greater than a submerged height of the outboard side wall upon the modified pontoon floating on a body of water, the body of water having a water surface. The inboard side wall is substantially perpendicular to the water surface. The bottom includes at least tow planing surfaces extending along a length of the modified pontoon, the at least two planing surfaces define a channel to produce lift upon the watercraft pontoon moving on the body of water.

The at least two planing surfaces can include an inboard planing surface connected to the inboard side, the inboard planing surface being substantially parallel to the water surface.

In a further aspect, there is provided a pontoon boat comprising two pontoons. Each pontoon includes an inboard side wall, an outboard side wall and a bottom. The inboard side wall and the outboard side wall are connected to the bottom. A submerged height of the inboard side wall is greater than a submerged height of the outboard side wall upon the pontoon floating on a body of water, the body of water having a water surface. The inboard side wall is substantially perpendicular to the water surface. The bottom includes at least two planing surfaces extending along a length of the pontoon. The at least two planing surfaces define a channel to produce lift upon the pontoon moving on the body of water.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a pontoon that allows for low speed planing of a pontoon boat and greater maneuverability of the pontoon in crosswind conditions and when turning.

Figure 1:
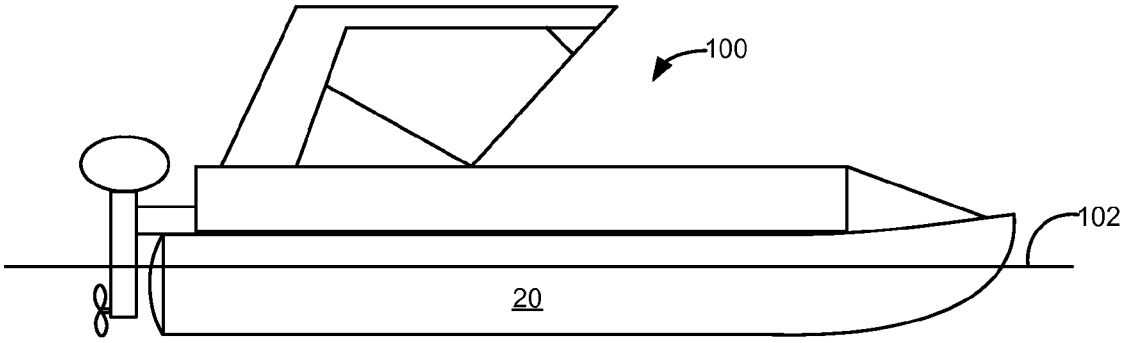
FIG. 1 is a side elevational view of a pontoon boat equipped with pontoons of the present invention.
Figure 2:
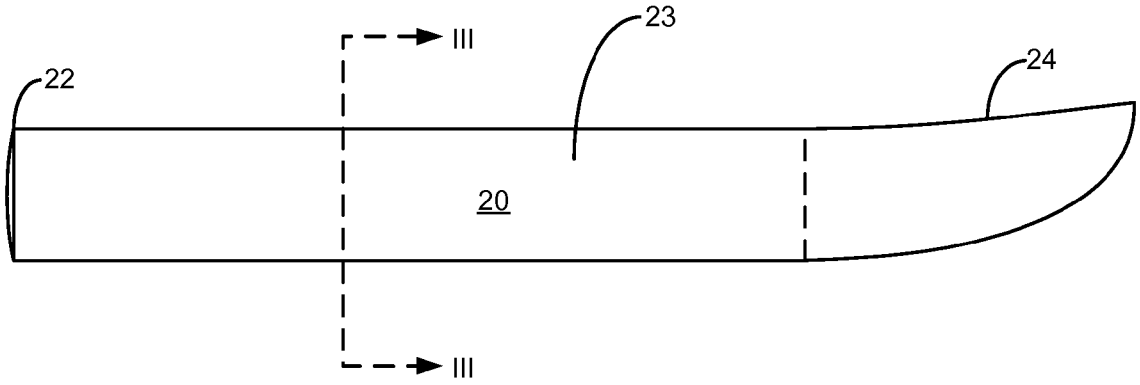
FIG. 2 is a side elevational view of an embodiment of a pontoon of the present invention.
Figure 4:
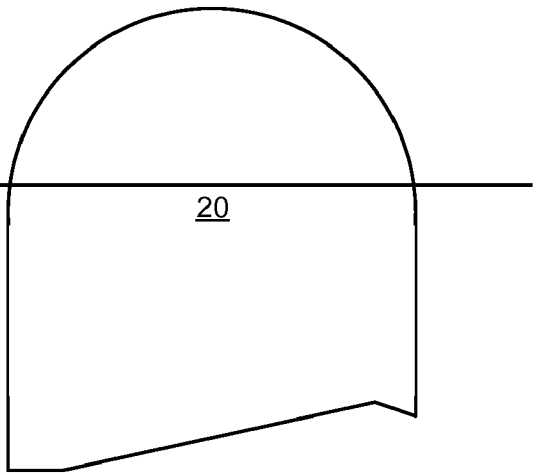
FIG. 4 is a mirror image of the pontoon of FIG. 3.
Figure 3:
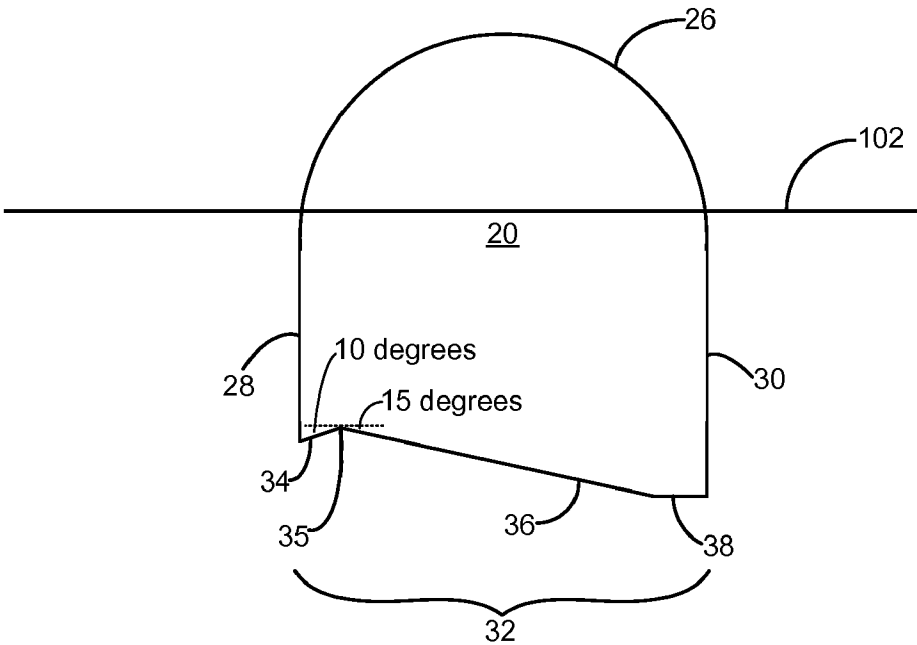
FIG. 3 is a cross-sectional view of an embodiment of a port side pontoon of the present invention.

FIG. 1 shows a side elevational view of a motor powered pontoon boat 100 equipped with pontoons 20 of the present invention. The pontoon boat 100 is shown floating on a body of water having a surface 102. The pontoons 20 can be secured to deck structure of the pontoon boat 100 through any suitable means. FIG. 2 shows a side elevational view of a pontoon 20, the pontoon 20 having a main section 23, a stern 22 and a bow 24. FIG. 3 shows a first exemplary cross-sectional view taken along the line III-III of the main section 23 of FIG. 2 for the port side pontoon. The starboard pontoon shown at FIG. 4 is the mirror image of the pontoon shown at FIG. 3.

With reference to FIG. 3, the pontoon 20 can include a top portion 26, an outboard side wall 28 and an inboard side wall 30. The pontoon 20 also includes a bottom 32 comprising planing surfaces 34, 36 and 38. Although three planing surfaces are shown, the pontoon 20 can include any suitable number of planing surfaces. The pontoon 20 can be manufactured out of any suitable material such as, for example, metal, plastic, fiberglass, wood, or combinations thereof. Further, the pontoon 20 can be hollow or filled with any suitable buoyant material, and the pontoon 20 can be made in accordance with any suitable manufacturing process.

The top portion 26 at FIG. 3 is shown as being arcuate but any other suitable shape is possible. The outboard side wall 28 and the inboard side wall 30 can be substantially parallel to each other. Further, the sides in question can be substantially perpendicular to the surface 102 defined by the body of water in which the pontoon 20 is immerged. Having the inboard side wall 30 and/or the outboard side wall 28 substantially perpendicular to the water surface 102 improves the stability and the maneuverability of the pontoon boat 100 in crosswind conditions and when turning. The planing surfaces 34, 36 and 38 of the bottom 32 are shown as all being substantially flat surfaces; however each planing surface can have any other suitable shape such as a concave shape. The generally angled profile defined by the planing surfaces 34, 36 and 38 and extending from the inboard side wall 30 to the outboard side wall 28 allows the pontoon 20 to cut through the water surface 102 and thus provides a smoother, less bumpy ride than with prior art pontoon boats. This generally angled profile can be defined by the height of the pontoon at the inboard side wall 30 being greater than the height of the pontoon at the outboard side wall 28. Alternatively, the generally angled profile can be defined by specifying that the submerged height of the inboard side wall is greater than the submerged height of the outboard side wall upon the pontoon floating on a body of water. The planing surface 38, as shown in the cross-sectional view of FIG. 3, can be substantially parallel to the surface 102. This orientation of the planing surface 38 improves the planing characteristics of the pontoon boat 100, particularly at low speeds. However, the relative width of the planing surface 38 with respect to the width of the pontoon 20 affects the ride quality of the pontoon boat. As will be understood by the skilled worker, having a relatively wide planing surface 38 allows greater planing capabilities; however, it can also make for ride rougher than with a relatively narrow planing surface 38.

As shown at FIG. 3, the planing surfaces 34 and 36 define a channel 35, which in this case has an inverted "V" shape. The angle of the inverted V-channel can be 155° or any other suitable angle. In the case of where the angle is 155°, the angle made by the planing surface 34 with the horizontal can be 10° while the angle made by the planing surface 36 with the horizontal can be 15°. When the pontoon boat 100 of FIG. 1 starts moving, it creates a bow wave. As the pontoon boat 100 keeps increasing its speed, the front of the boat will rise slightly and the channel 35, and the planing surface 38 will deflect water downwards as the pontoon boat 100 travels on the water surface 102, thereby producing lift of the pontoons 20 and of the pontoon boat 100. The inverted V-channel 35 and the planing surface 34 promotes water deflected by this planing surface toward the outboard side of the pontoon to flow in a laminar way, which improves lift. Further increase in speed can lead the pontoon boat to overtake its bow wave and start planing on the body of the water surface 102, thereby achieving speeds greater than those available to standard pontoon boats. As an example, for a 20-foot long pontoon boat equipped with pontoons such as pontoons 20, planing speeds of about 14 knots can be achieved. The ability to plane at such low speeds substantially increases the fuel economy of the boat. With respect to typical speeds that can be reached, a 20-foot pontoon boat equipped with pontoons such as pontoons 20 can travel at about 40 miles per hour when equipped with a 115 horsepower motor and at about 50 miles per hour with a 150 horsepower motor.

Figure 5:
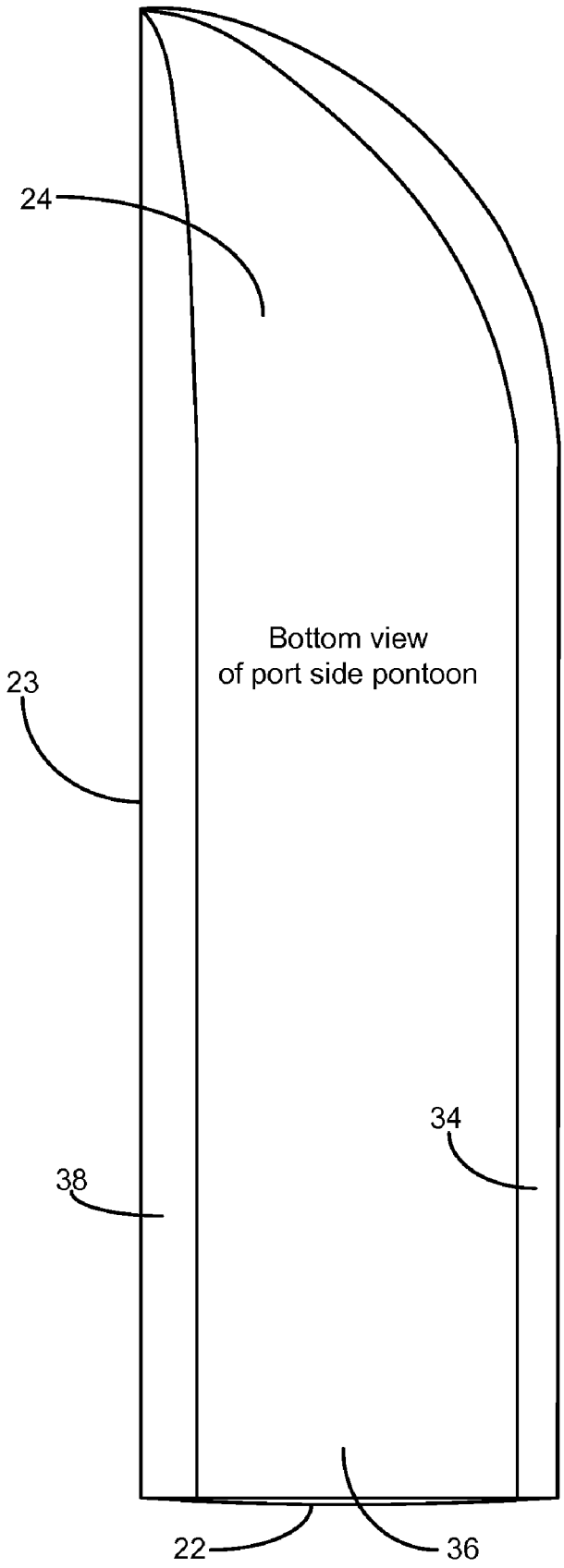
FIG. 5 is a bottom view of the port side pontoon of FIG. 3.

FIG. 5 shows a bottom view of the exemplary port side pontoon 20 of FIG. 3. FIG. 5 shows the planing surfaces 34, 36 and 38 extending from the stern 22 to the bow 24 of the pontoon. As seen in the bow section 24, the outboard side wall of the pontoon curves towards the inboard side wall and the width of the planing surfaces 34, 36 and 38 decreases as they curve towards the inboard side wall of the bow section 24. Alternatively, the bow section 24 can have its forward section terminated in any other suitable way such as with a nose cone secured thereto through any suitable means. With respect to the stern 22, it can be made substantially flat to reduce drag.

Figure 6:
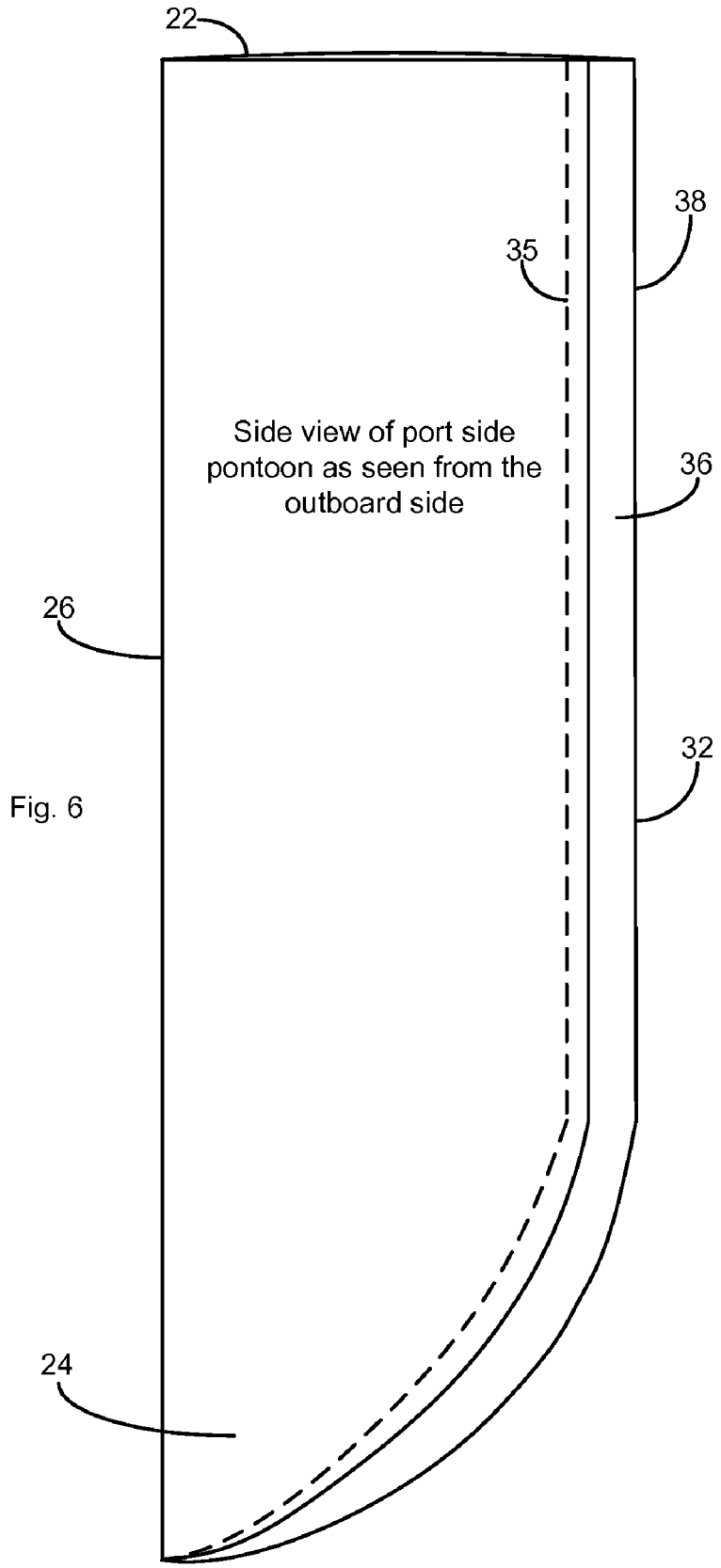
FIG. 6 is a side view of the pontoon of FIG. 3 as seen from the outboard side.

FIG. 6 shows a side view of the pontoon of FIG. 3 as seen from the outboard side of the pontoon. FIG. 6 shows the planing surfaces 36 and 38, and the channel 35, extending from the stern section 22 to the bow section 24. As seen in the bow section 24, the height of the bottom side 32 of the pontoon curves toward the top 26 and the height of the planing surfaces 34 (not seen at FIG. 6) and 36 decreases as they curve towards the top section 26.

Alternatively, the bow section can be manufactured separately from the main section and fitted to the main section afterwards. The cross-section profile of the bow section can be of any suitable type and can be made to transition smoothly from the bow to the main section The pontoon 20 of the present invention can be of any suitable length, width and height. As an example, a pontoon 20 can be 20 feet long, 24 inches wide and 28 inches high at the centre. Further, for the pontoon in question, each of the planing surfaces 34 and 38 can account for 4 inches of the width while the planing surface 36 can account for 16 inches. It is not required that the planing surfaces be the same width and any other suitable widths of the planing surfaces 34, 36 and 38 are possible.

As mentioned, the pontoons 20 of FIGS. 3-5 can be made of any suitable material and through any suitable manufacturing process. One such material is aluminum (e.g., marine grade aluminum) in sheet format. These aluminum sheets can be subjected to suitable press brakes, or any other suitable type of machinery, to form the main section 23, the bow section 24 and the stern section 22. Welding and/or any other suitable means, can be used to seal the processed aluminum sheet into a closed shape.

Figure 7:
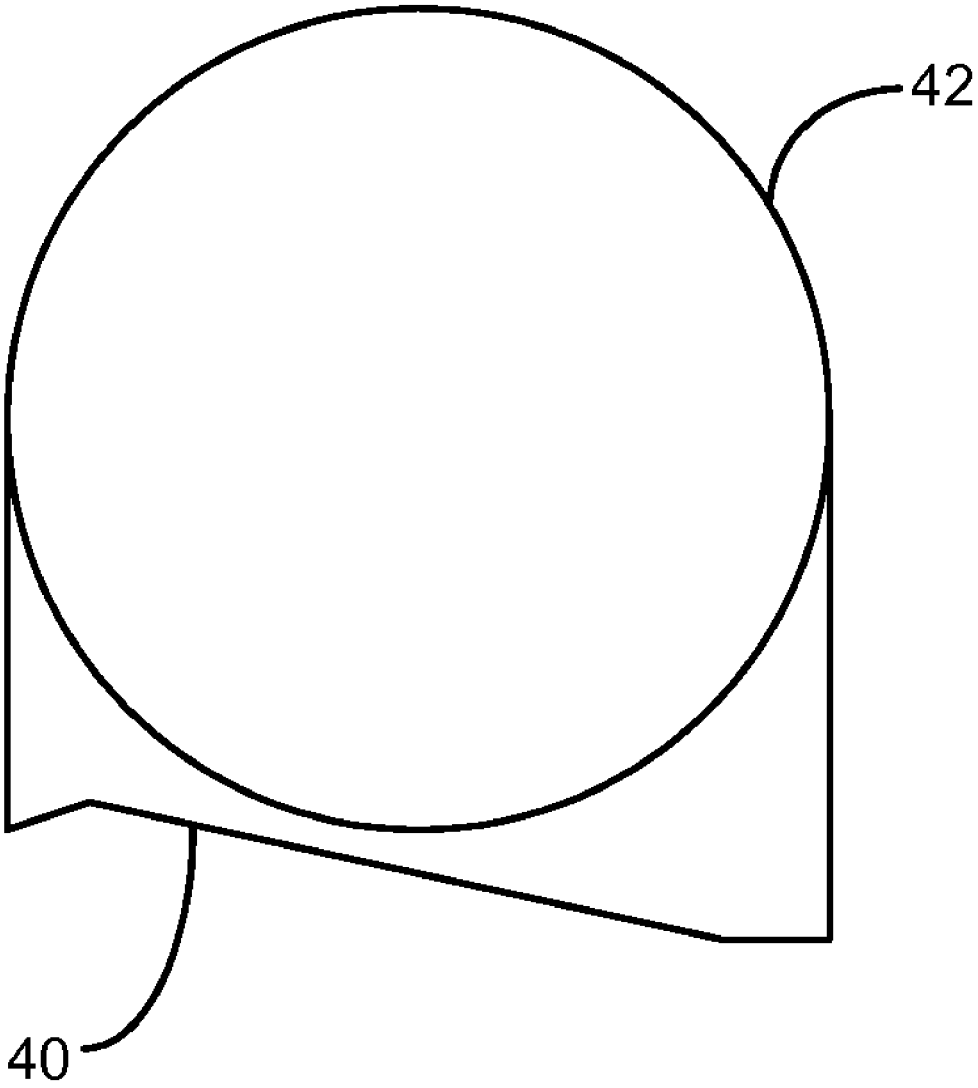
FIG. 7 is a cross-sectional view of a pontoon fitted with an add-on profile of the present invention.

The pontoon 20 can also be made by retrofitting an existing pontoon with an add-on profile or contoured surface such as shown at FIG. 7. The add-on profile 40 can be made of marine grade aluminum or any other suitable material and can be manufactured through any suitable process. For example, sheets of marine grade aluminum can be formed into the shape of add-on profile 40 shown at FIG. 7 through press brakes. The add-on profile 40 can then be secured to an existing pontoon 42 through any suitable means. Thus, an owner of a standard pontoon boat can easily upgrade to a better performing boat simply by purchasing and installing an upgrade kit including a pair of add-on profiles 40.

Figure 8:
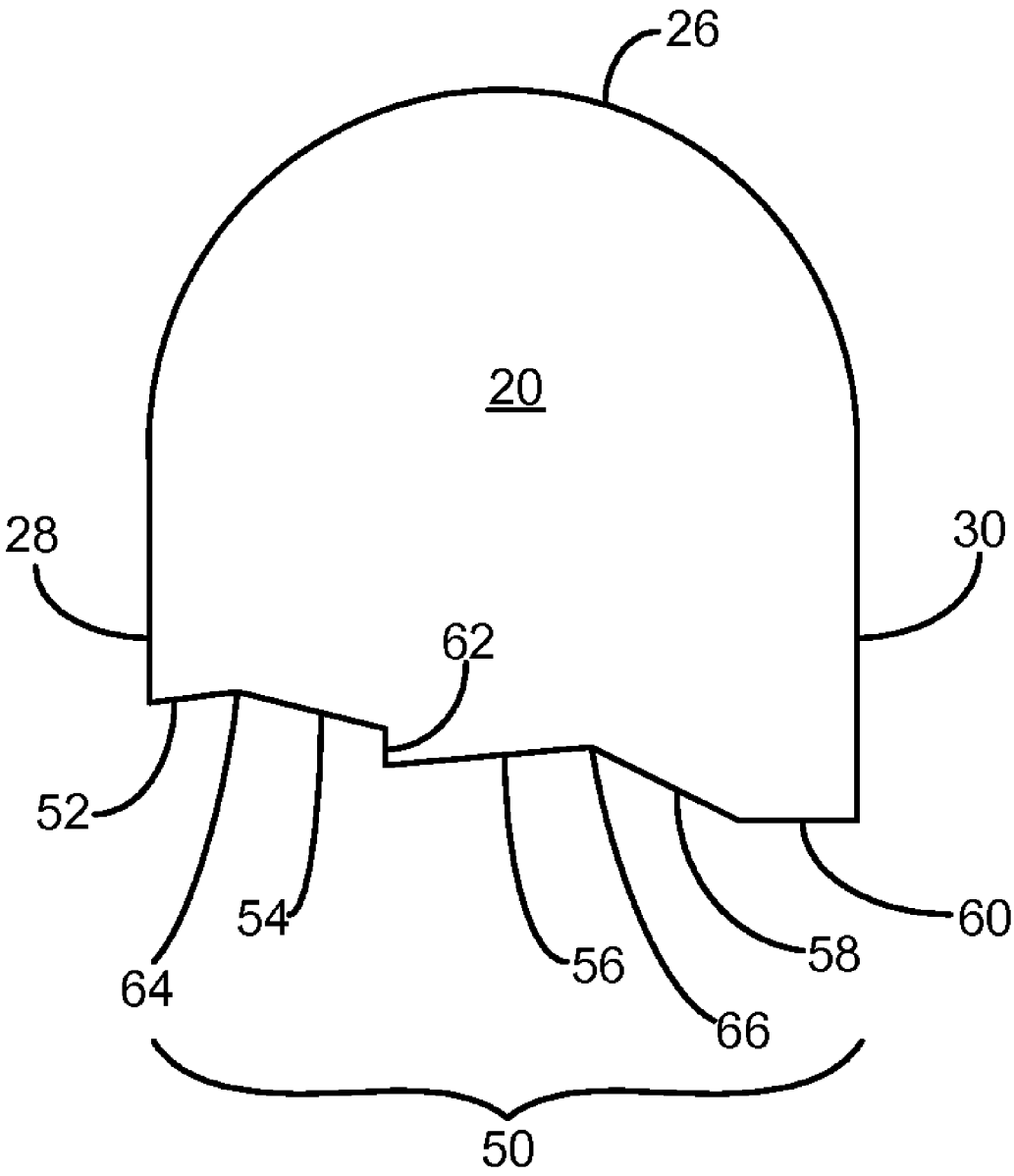
FIG. 8 is a cross-sectional view of another embodiment of the pontoon of the present invention.

FIG. 8 shows another exemplary cross-sectional view taken along the line III-III of the main section 23 of FIG. 2 for a port side pontoon. As will be understood by the skilled worker, the cross section of the starboard pontoon (not shown) is the vertical mirror image of FIG. 8.

The exemplary pontoon 20 of FIG. 8 is shown with a top portion 26, an outboard side wall 28 and an inboard side wall 30, which can all be as described above in relation to FIG. 3. The bottom section 50 includes planing surfaces 52, 54, 56, 58 and 60, and a wall segment 62. The planing segments 52 and 54 define a channel 64 while the planing surfaces 56 and 58 define a second channel 66. The angles of the channels 64 and 66 can be similar to that of the channel 35 of FIG. 3. That is, it can be 155° or any other suitable angle. Further, the planing surfaces 58 and 58 can be at the same angle, and the planing surfaces 52 and 56 can be at the same angle. As in the case of the pontoon profile discussed with relation to FIG. 3, the pontoon of FIG. 7 will experience lift as the pontoon boat 100 is propelled forward and water is deflected downwards by the channels 64 and 66 and by the planing surfaces.

The bottom of the pontoon shown at FIG. 8 has a low speed planing section and a high speed planing section. The low speed planing section essentially spans the total width of the pontoon and includes the planing surfaces 52, 54, 56, 58 and 60. The high speed planing section is defined by the width of planing surfaces 56, 58 and 60. At relatively low planing speed, the entire low speed planing section of the main portion of the pontoon remains in contact with the body of water. As the speed of the pontoon boat increases, the pontoons experience increased lift and eventually, the planing surfaces 52 and 54 can rise above the water surface 102 (FIG. 1) leaving only the planing surfaces 56, 58 and 60, i.e., the high speed planing section in the water. At such high planing speeds, the substantially vertical wall 62 helps maintain good maneuverability of the pontoon boat in crosswind condition.

For a 24-inch wide pontoon, the widths of the planing surfaces 52, 54, 56, 58 and 60 can respectively account for 3, 5, 6, 6 and 4 inches of the pontoon width. Any other suitable widths can also used.

Another exemplary embodiment of the present invention is that of a pontoon similar to that shown at FIG. 8 but without the vertical wall 62, i.e., with the planing surfaces 54 and 56 connected directly to each other.

Those skilled in the art will understand that combinations of the planing surface configurations shown in FIGS. 3 and 8 are possible. For example, planing surfaces 56 and 58 can be replaced with a single planing surface spanning between vertical wall 62 and an end of planing surface 60.

In the preceding description, for purposes of explanation, numerous details are set forth in order to provide a thorough understanding of the embodiments of the invention. However, it will be apparent to one skilled in the art that these specific details are not required in order to practice the invention. In other instances, well-known electrical structures and circuits are shown in block diagram form in order not to obscure the invention. For example, specific details are not provided as to whether the embodiments of the invention described herein are implemented as a software routine, hardware circuit, firmware, or a combination thereof.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A pontoon for a watercraft, the pontoon comprising: an inboard side wall with a submerged depth greater than an outboard side wall along a length of the pontoon, and the inboard and outboard side walls are parallel to each other along the length of the pontoon, as the inboard wall is substantially perpendicular to a water surface, when the pontoon is floating, and a bottom connects the inboard and outboard side wall, along the length at their greatest depths, with the bottom comprised of a flat surface perpendicular to the inboard side wall attached at the greatest depth of the inboard wall along the length, this flat surface is attached to an angled surface which rises to meet a surface which angles down, which these surfaces use to generate hydrodynamic force away from a hull, and the angled down surface attaches to a small vertical surface, and at the highest point of the vertical surface, an angled surface attaches and rises up, where this surface meets another surface which angles down, then this surface provides additional planing and hydrodynamic force, and this surface ends at the outboard wall, while the sets of angled surfaces and the perpendicular surface at its greatest depth, comprise a multi-level planing surface, and all surfaces run the length of the pontoon, as well, the pontoon comprises an arcuate top, and this bottom configuration may be an original pontoon or an added surface.

* * * * *